US008400073B2

(12) United States Patent
Byun et al.

(10) Patent No.: US 8,400,073 B2
(45) Date of Patent: Mar. 19, 2013

(54) BACKLIGHT UNIT WITH CONTROLLED POWER CONSUMPTION AND DISPLAY APPARATUS HAVING THE SAME

(75) Inventors: Sang-Chul Byun, Anyang-si (KR); Byoung Dae Ye, Yongin-si (KR); Yong-Hoon Kwon, Asan-si (KR); Byungchoon Yang, Seoul (KR); Young-keun Lee, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 434 days.

(21) Appl. No.: 12/689,968

(22) Filed: Jan. 19, 2010

(65) Prior Publication Data

US 2011/0012521 A1 Jan. 20, 2011

(30) Foreign Application Priority Data

Jul. 16, 2009 (KR) ..... 10-2009-0064995

(51) Int. Cl.
*H05B 37/02* (2006.01)

(52) U.S. Cl. ..... 315/291; 315/307; 315/308; 345/204

(58) Field of Classification Search .... 315/169.1–169.4, 315/209 R, 291, 307, 308, 185 R, 299, 312, 315/360, 361; 345/48, 76–82, 204, 211–214
See application file for complete search history.

(56) References Cited

U.S. PATENT DOCUMENTS

| | | | | |
|---|---|---|---|---|
| 7,348,948 | B2 * | 3/2008 | Crawford et al. | 345/82 |
| 7,825,610 | B2 * | 11/2010 | Zhao et al. | 315/299 |
| 2007/0080911 | A1 | 4/2007 | Liu et al. | |
| 2007/0296353 | A1 | 12/2007 | Ito et al. | |
| 2008/0043008 | A1 * | 2/2008 | Wang | 345/211 |

FOREIGN PATENT DOCUMENTS

| | | | |
|---|---|---|---|
| JP | 2007-110070 | A | 4/2007 |
| JP | 2007-134430 | A | 5/2007 |
| KR | 1020070040282 | A | 4/2007 |
| KR | 1020070084072 | A | 8/2007 |

* cited by examiner

*Primary Examiner* — Jimmy Vu
(74) *Attorney, Agent, or Firm* — Innovation Counsel LLP

(57) ABSTRACT

In a display apparatus having a backlight unit, a light unit includes plural light source strings commonly connected to an output terminal of a boosting circuit to generate light in response to a light source driving voltage. The light source strings are grouped into plural light generating groups. Plural driving circuits are respectively connected to the light generating groups, and each driving circuit sequentially outputs feedback voltages from the light source strings of a corresponding light generating group. A minimum voltage detecting circuit compares the feedback voltages with each other from the driving circuits to detect a minimum voltage and outputs a control signal according to the detected minimum voltage. A voltage control circuit controls a voltage level of the light source driving voltage in response to the control signal. Accordingly, although the number of the driving circuits increases, power consumption used in each driving circuit may be reduced.

18 Claims, 8 Drawing Sheets

BACKLIGHT UNIT WITH CONTROLLED POWER CONSUMPTION AND DISPLAY APPARATUS HAVING THE SAME

CROSS-REFERENCE TO RELATED APPLICATION

This application relies for priority upon Korean Patent Application No. 2009-64995 filed on Jul. 16, 2009, the contents of which application are herein incorporated by reference in its entirety.

BACKGROUND

1. Field of Disclosure

The present disclosure of invention relates to a backlight unit and a display apparatus having the same. More particularly, the present disclosure relates to a backlight unit capable of operating with controlled or reduced power consumption and a display apparatus having such a low power backlight unit.

2. Description of Related Technology

In general, a conventional liquid crystal display (LCD) includes a set of liquid crystal display panels or substrates having liquid crystal material interposed between them and defining a plurality of electronically controllable light shutters which can be selectively actuated so as to display desired black and white or colored images. Typically a backlight providing unit is disposed under the liquid crystal display panels to supply backlighting light to the panels for passage through the electronically controllable light shutters defined by the panels.

In a case where light emitting diodes (LED's) are employed as the light sources of the backlight unit, the backlight unit is typically structured to include a plurality of strings of light emitting sources where the strings are connected substantially in parallel and where each string contains a plurality of series connected LED's or other light sources. The backlight unit is typically further structured to include a DC/DC converter that supplies an appropriate range of DC driving voltages to the light source strings, and one or more driver IC's connected to corresponding ones or groups (banks) of the light source strings by a respective plurality of connection channels. However, what constitutes an appropriate range of DC driving voltages may vary with conditions.

Recently, because of growth in size of LCD panels, the number of light source strings that are used has gradually increased. However, because the number of connection channels that are drivable by each given driver IC is limited by its design to a fixed number of channels, the number of the driver IC's that have to employed inside the backlight unit has increased in accordance with the commensurate increase in the number of utilized light source strings. This increase in number of driver ICs creates the problem of how to efficiently regulate the system without substantial increases in size and cost of power control circuits included in the backlight unit.

SUMMARY

An exemplary embodiment of a backlight unit in accordance with the disclosure includes a boosting circuit, a light source unit, a plurality of driving circuits, a minimum voltage detecting circuit, and a voltage control circuit.

The boosting circuit boosts an input voltage to a light source driving voltage. The light source unit includes a plurality of light source strings commonly connected to an output terminal of the boosting circuit to generate a light in response to the light source driving voltage. The light source strings are grouped into a plurality of light generating groups. The driving circuits are connected to the light generating groups, respectively. Each of the driving circuits sequentially outputs the feedback voltages fedback from the light source strings of a corresponding light generating group of the light source generating groups.

The minimum voltage detecting circuit receives the feedback voltages from the driving circuits, compares the feedback voltages with each other to detect a minimum voltage, and outputs a control signal according to the detected minimum voltage. The voltage control circuit controls the boosting circuit in response to the control signal to control a voltage level of the light source driving voltage supplied to the light source unit.

According to another exemplary embodiment, a display apparatus includes a backlight unit generating a light and a display unit receiving the light to display an image. The backlight unit includes a boosting circuit, a light source unit, a plurality of driving circuits, a minimum voltage detecting circuit, and a voltage control circuit.

The boosting circuit boosts an input voltage to a light source driving voltage. The light source unit includes a plurality of light source strings commonly connected to an output terminal of the boosting circuit to generate a light in response to the light source driving voltage. The light source strings are grouped into a plurality of light generating groups. The driving circuits are connected to the light generating groups, respectively. Each of the driving circuits sequentially outputs the feedback voltages fedback from the light source strings of a corresponding light generating group of the light source generating groups.

The minimum voltage detecting circuit receives the feedback voltages from the driving circuits, compares the feedback voltages with each other to detect a minimum voltage, and outputs a control signal according to the detected minimum voltage. The voltage control circuit controls the boosting circuit in response to the control signal to control a voltage level of the light source driving voltage supplied to the light source unit.

According to the above, in a case that LED strings are operated by driver ICs, each driver IC includes a voltage output unit outputting the feedback voltages and the minimum voltage detecting circuit is provided outside the driver ICs. Thus, the minimum voltage of the feedback voltages of the LED strings may be effectively detected over a shared feedback line without relation to the number of the driver ICs.

In addition, since the voltage level of the light source driving voltage applied to the LED strings is controlled by using the detected minimum voltage, power consumption used in the driver ICs may be controlled to be within a predefined power range and to avoid becoming excessive so as to overheat the driver ICs.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
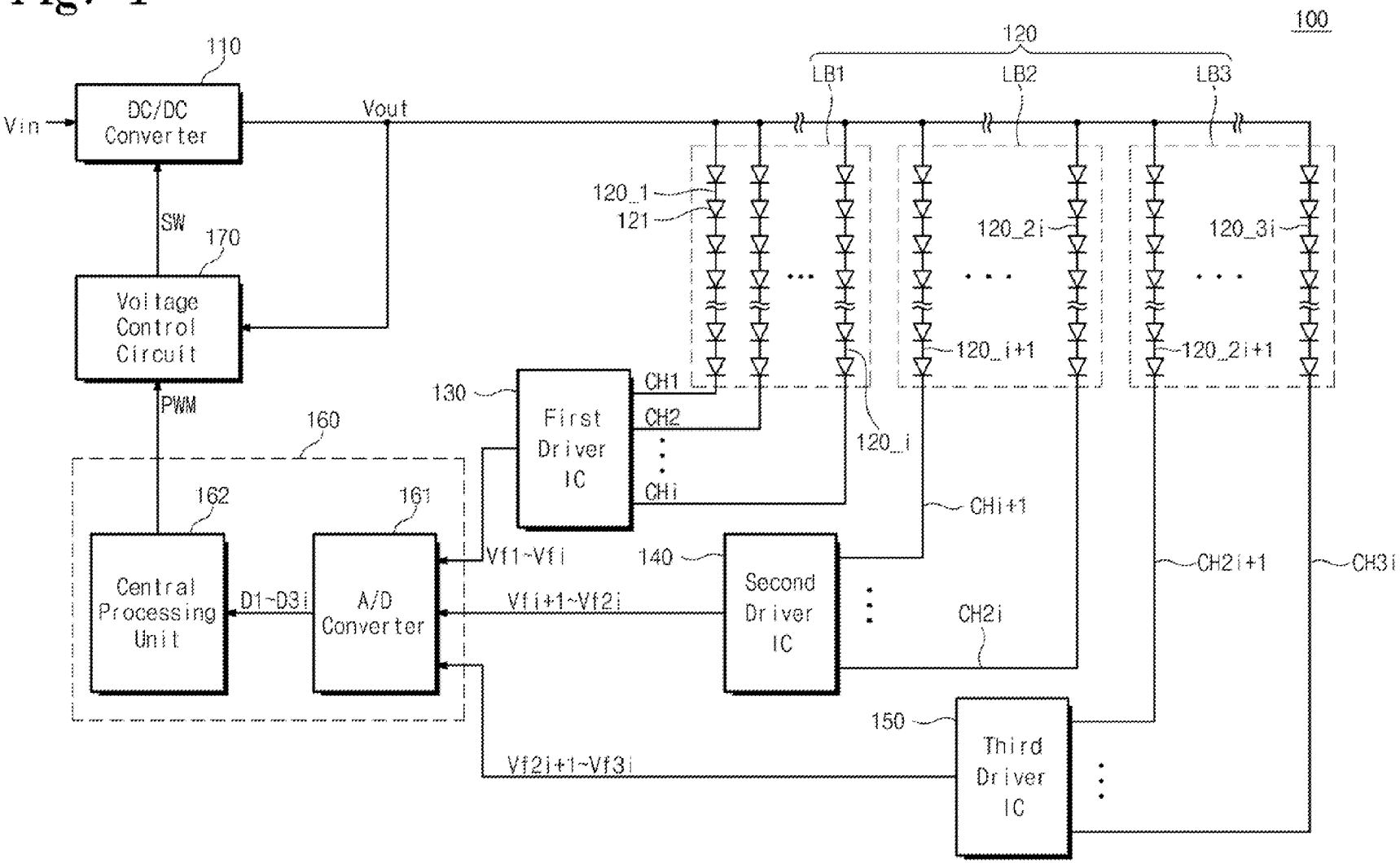
FIG. 1 is a block diagram showing an exemplary embodiment of a backlight unit according to the present disclosure.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure most closely pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present disclosure of invention will be provided in greater detail with reference to the accompanying drawings.

FIG. 1 is a block diagram showing an exemplary embodiment of a backlight unit according to the present disclosure.

Referring to FIG. 1, a backlight unit 100 includes a DC-to-DC converter 110 which receives an input DC voltage, Vin and outputs a controlled DC voltage, Vout to an attached light source unit 120. The DC/DC converter 110 may input appropriate power switcher circuitry and it operates to boost (increase) the input voltage Vin to thereby provide a greater output voltage Vout because the long series of LED's in each string (e.g., string 120_1 through 120_3*i*) generally require a relatively large driving voltage, Vout to support sufficient current for lighting the LED's to a desired luminance level. As seen in FIG. 1, the illustrated light source unit 120 includes a plurality of light source strings enumerated respectively as 120_1 through 120_3*i* and connected so as to be driven roughly in parallel with one another. Each of the light source strings 120_1~120_3*i* may include a plurality of light emitting diodes (LEDs, one denoted as 121) connected to each other in series as shown.

The number of LEDs 121 included in each of the light source strings 120_1~120_3*i* and the number of the light source strings 120_1~120_3*i* provided within the backlight unit 100 may vary and may depend upon the size of the display apparatus and the capability of the individual LEDs 121 (or other utilized light emitting components).

In addition to the light source strings, the backlight unit 100 includes one or more driver ICs connected and structured to control the operation of the light source strings (hereinafter, also referred to as LED strings) 120_1~120_3*i*. The light source strings may be grouped into light source banks (LB1, LB2, LB3, etc.) where the number of strings in each bank may depend on the number of strings controllable by each driver IC (130, 140, . . . 150) and the total number banks may depend on the number of the driver ICs provided in the backlight unit 100.

In one embodiment, the backlight unit 100 includes first, second, and third driver ICs respectively denoted as 130, 140, and 150 and each having a predefined integer number, i of channels. Thus, the total plurality of LED strings 120_1~120_(2*i*+1)~120_3*i* may be grouped into first, second, and third light generating groups or banks, LB1, LB2, and LB3, each having i strings where these banks correspond to the first, second, and third driver ICs 130, 140, and 150 in a one-to-one relationship. That is, each of the first to third driver ICs 130, 140 and 150 is connected to the light source strings included in a corresponding light generating group of the light generating banks LB1, LB2, and LB3.

Each of the first to third driver ICs 130, 140, and 150 has a capability to control up to i channels. Accordingly, the number of the LED strings in the backlight unit 100 depends on the number of controllable channels provided by the circuit design of the corresponding driver ICs, the number of IC's and the extent to which the i channel drive terminals of each IC are utilized. For instance, in a case of an i=6-channels driver IC being used, each light generating group may consist of six LED strings. However, since the number of channels processable by one driver IC is limited by its design (e.g., $i_{max}$=6), the number of such driver ICs increases in accordance with the increase of the total number of LED strings 120_1~120_3*i* used in the backlight unit 100. For the convenience of explanation, in the present exemplary embodiment, three driver ICs 130, 140 and 150 have been shown, but the number of the driver ICs should not be limited thereto or hereby.

It is helpful to determine how much electrical current, $I_{string}$ is being drawn by each of the light source strings. Accordingly, the first to third driver ICs 130, 140, and 150 sequentially output voltages Vf1~Vf3*i* fedback from the corresponding LED strings, 120_1~120_3*i*. The feedback voltages Vf1~~Vf3*i* may be sequentially output from the first to third driver ICs 130, 140, and 150 as serial feedback information in the order of the first, second, and third driver ICs 130, 140, and 150, or they may be substantially simultaneously output from the first to third driver ICs 130, 140, and 150 to one or more receiving A/D converters (only one shown as A/D converter 161).

The backlight unit 100 further includes a minimum voltage identifying circuit 160 (dashed box) and an associated voltage control circuit 170. The minimum voltage identifying or detecting circuit 160 includes at least one analog-to-digital (A/D) converter 161 and a central processing unit (CPU) 162 that is operatively coupled to that A/D converter. Those skilled in the art will appreciate that the illustrated voltage identifying circuit 160 may be implemented in other forms including that of a microcontroller monolithic integrated circuit having integrated A/D converters and a programmable data processor provided therein. The A/D converter 161 receives the feedback voltages Vf1~Vf3*i* from the first to third driver ICs 130, 140, and 150 and converts the feedback voltages Vf1~Vf3*i* into corresponding plurality of 3*i* digital signals, D1~D3*i* that are transmitted to the CPU. The central processing unit 162 compares the received digital signals D1~D3*i* relative to each other, and determines which of the digital signals D1~D3*i*, corresponds to a minimum voltage ($V_{fMIN}$) among the feedback voltages Vf1~Vf3*i*. The CPU 162 then produces a pulse width modulating control signal PWM in accordance with the magnitude of the identified minimum feedback voltage, $V_{fMIN}$, and supplies the control signal PWM to the voltage control circuit 170.

The voltage control circuit 170 receives the control signal PWM from the central processing unit 162 and it also receives the light source driving voltage Vout produced from the DC/DC converter 110. The voltage control circuit 170 outputs a switching control signal SW to the internal switcher circuitry (not shown) of the DC/DC converter 110 in response to the light source driving voltage Vout and the control signal PWM to thereby control the output of the DC/DC converter 110. The DC/DC converter 110 may then correspondingly change the voltage level of the light source driving voltage Vout in response to the switching signal SW FIG. 2 is a block diagram showing only a portion of the circuitry of FIG. 1 with the first, second, and third driver ICs of FIG. 1 being illustrated in greater detail.

Figure 2:
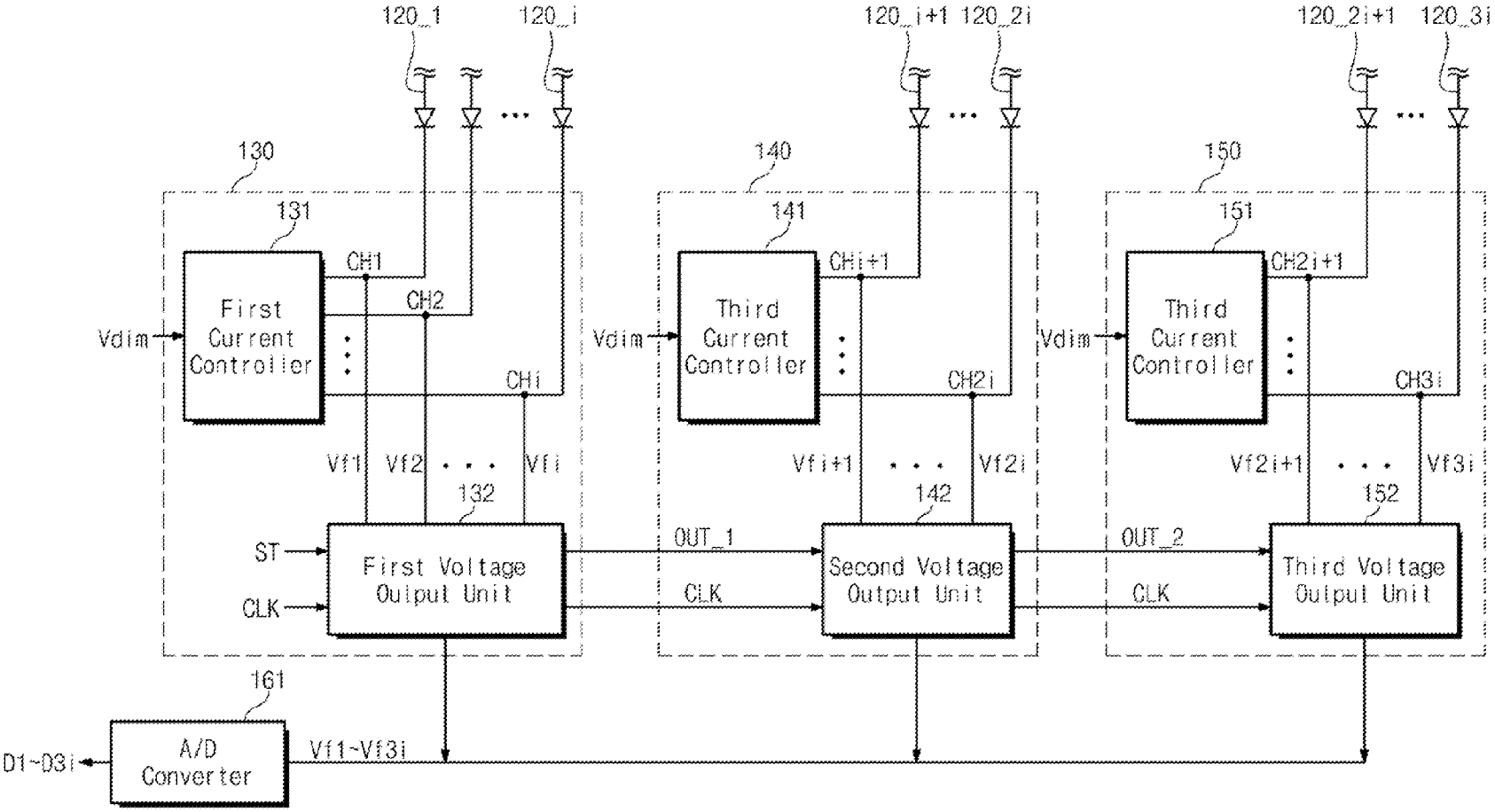
FIG. 2 is a block diagram showing first, second, and third driver ICs of FIG. 1.

Referring to FIG. 2, the first driver IC 130 (shown as a dashed box) includes a corresponding first current controller 131 and a corresponding first voltage output unit 132.

The first current controller 131 receives a dimming control signal, Vdim (e.g., from CPU 162) and is connected to the LED strings 120_1~120_*i* through its respectively channel connections, CH1~CHi. The current controller 131 is structured to control the brightness (luminance) of the light exiting from the LED strings 120_1~120_*i* in response to the dimming signal Vdim. In one embodiment, the dimming signal Vdim is synchronized with an image signal applied to the optical shutters of the display panel so that the combination of shutter operation (e.g., pixel-electrode voltage) and backlight dimming operation provide a desired optical image effect. In one embodiment, the dimming control signal, Vdim is pulsed to have a duty ratio corresponding to a desired brightness level desired of its bank or group of backlight lighting strings. In other words, the brightness of the light from the LED strings 120_1~120_*i* may be controlled by the duty ratio of the dimming signal Vdim applied to the first current controller module 131.

Depending on the design of the backlight unit, the dimming signal Vdim applied to the first current controller module 131 may be a global dimming signal used to control the whole brightness of the backlight unit or it may be a local dimming signal used to locally dim the brightness of the group of LED strings to which it is directed (e.g., 120_1 through 120_*i*). Particularly, in case of the local dimming method, the brightness of a first group or bank may be dynamically increased for an image area in which a bright image is to be displayed, and the brightness of a second group or bank may be dynamically decreased in an image area in which a darker image is to be displayed. Because luminosity in the display area is controlled both by shutter operation and by localized backlight dimming, a contrast ratio of the imagery displayed in adjoining, that backlight dimmed areas may be enhanced, and power consumption used in the backlight unit 100 may be simultaneously reduced.

The first feedback voltages outputting unit 132 is connected to the channels CH1~CHi to receive the corresponding feedback voltages Vf1~Vfi fedback from the respectively LED strings 120_1~120_*i*. As will be seen in FIG. 3, the first feedback voltages outputting unit 132 includes a shift register that controls which of the feedback voltages is currently being output by the first feedback voltages outputting unit 132. Accordingly, the first voltage output unit 132 receives a shift-register (ShftReg) controlling start signal, ST and a ShftReg controlling clock signal, CLK. In detail, the first voltage output unit 132 starts its operation in response to the start signal ST and sequentially outputs the respectively feedback voltages Vf1~Vfi to the A/D converter 161 in synchronism with the clock signal CLK.

Similar to the first driver IC 130, the second driver IC 140 includes a second current controller 141 connected to the LED strings 120_*i*+1~120_2*i* through the channels CHi+1~CH2*i*, and the third driver IC 150 includes a third current controller 151 connected to the LED strings 120_2*i*+1~120_3*i* through the channels CH2*i*+1~CH3*i*.

In addition, the second driver IC 140 further includes a second feedback voltages outputting unit 142 connected to the channels CHi+1~CH2*i* to receive the feedback voltages Vfi+1~Vf2*i* fedback from the LED strings 120_*i*+1~120_2*i*. The second voltage output unit 142 starts its operation in response to an output signal OUT_1 output from the first voltage output unit 132 and sequentially outputs the feedback voltages Vfi+1~Vf2*i* to the A/D converter 161 in synchronization with the clock signal CLK.

The third driver IC 150 further includes a third feedback voltages outputting unit 152 connected to the channels CH2*i*+1~CH3*i* to receive the voltages Vf2*i*+1~Vf3*i* fedback from the LED strings 120_2*i*+1~120_3*i*. The third voltage output unit 152 starts its operation in response to an output signal OUT_2 output from the second voltage output unit 142 and sequentially outputs the feedback voltages Vf2*i*+1~Vf3*i* to the A/D converter 161 in synchronization with the clock signal CLK.

The feedback voltages Vf1~Vf3*i* provided sequentially to the A/D converter 161 along feedback line FL (see FIG. 3) are converted to the corresponding digital signals D1~D3*i* and the latter are provided to the central processing unit (CPU) 162.

It is to be understood that only one exemplary embodiment of how to configure the first to third voltage output units 132, 142, and 152 and how to sequentially operate them has been shown in conjunction with FIG. 2. Other configurations are possible. For example, each of the first to third voltage output units 132, 142, and 152 may independently receive its own start signal ST, each may have its own private feedback line (FL) and each may substantially simultaneously start its operation in response to its ST signal. In this case, since the first to third voltage output units 132, 142, and 152 substantially simultaneously output the feedback voltages Vf1~Vf3*i*, the number of the A/D converters like 161 that are provided is increased to be at least three.

Figure 3:
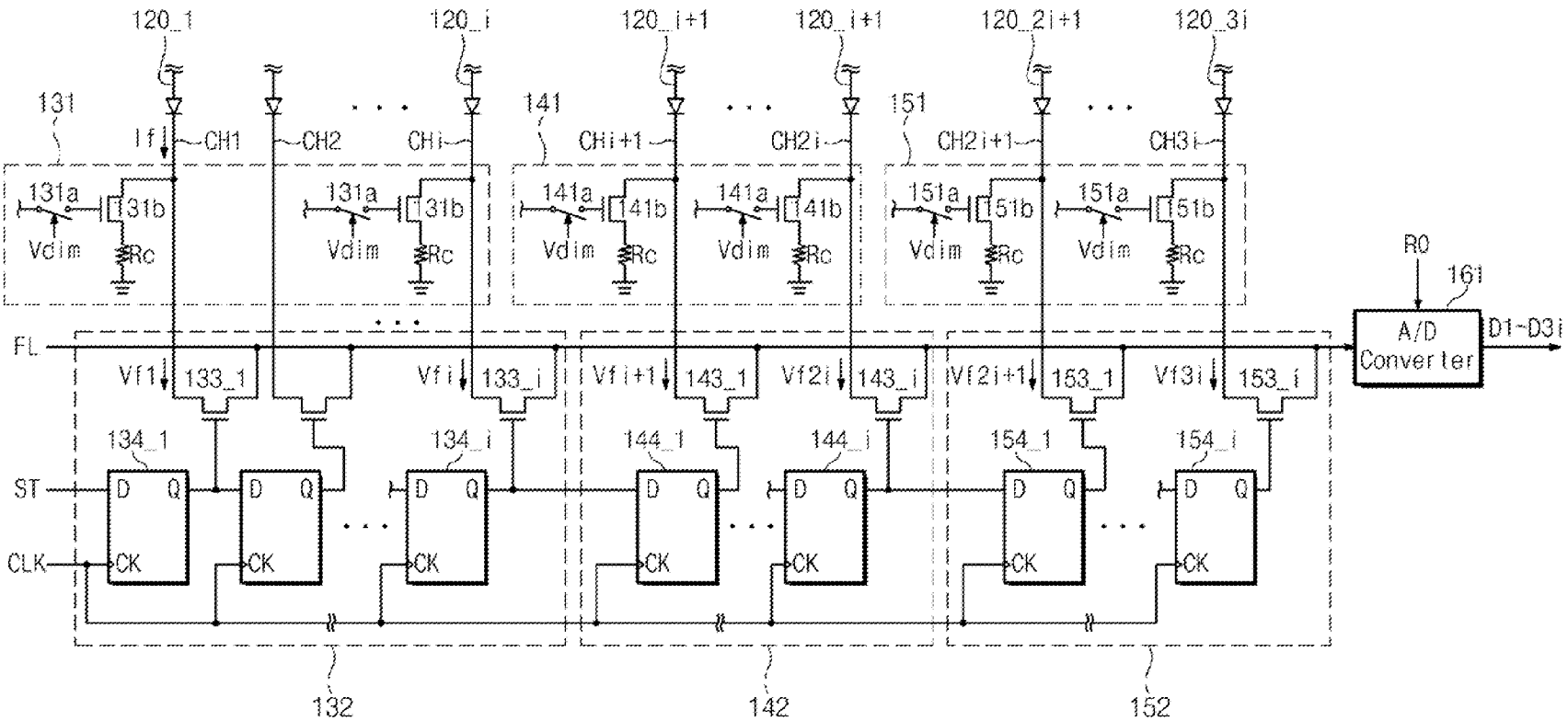
FIG. 3 is a circuit diagram showing first, second, and third driver ICs of FIG. 2.
Figure 4:
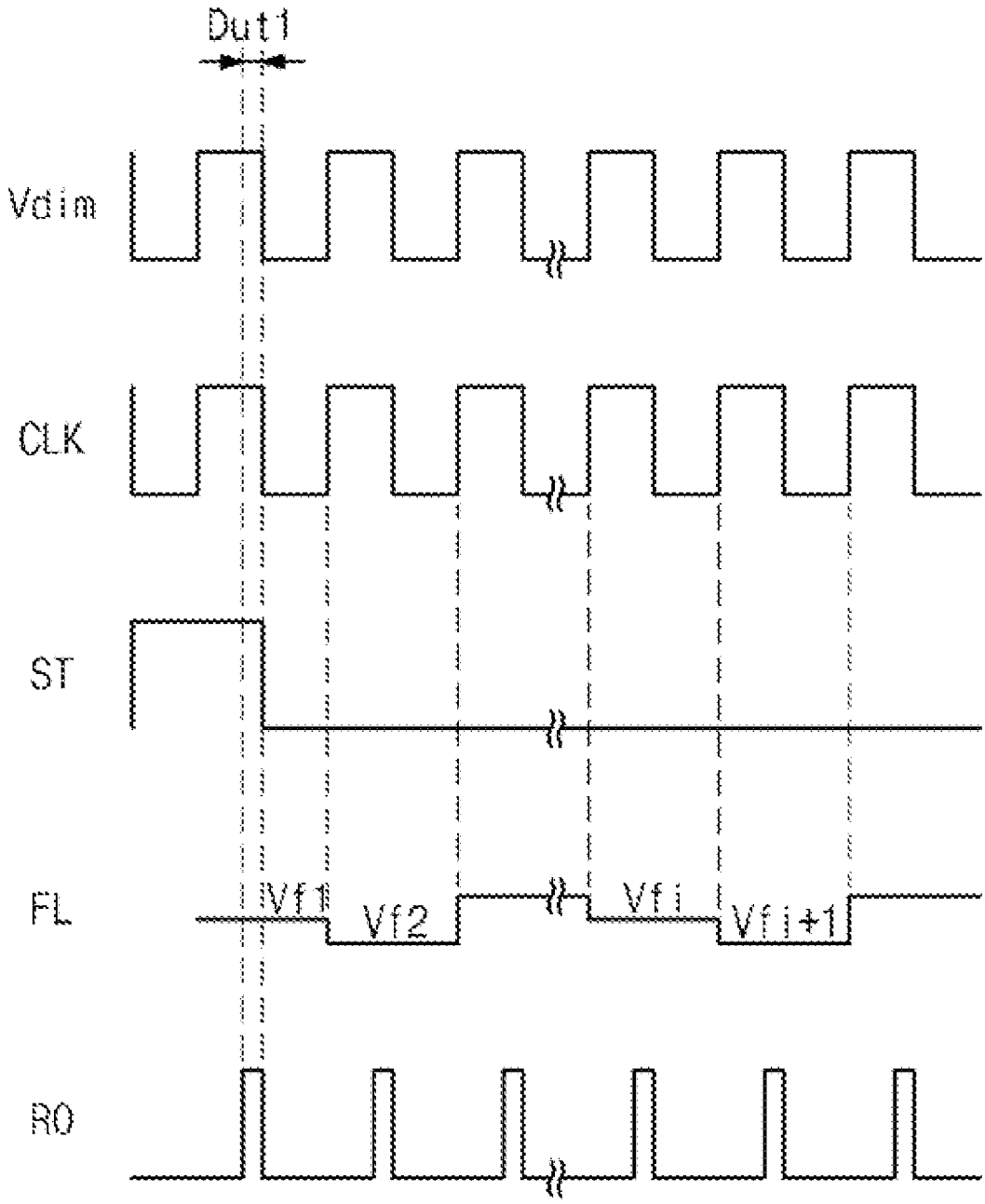
FIG. 4 is a waveforms diagram of signals of FIG. 3.

FIG. 3 is a more detailed circuit diagram showing internal structures of the first, second, and third driver ICs of FIG. 2. FIG. 4 is a waveforms diagram of signals used in the circuit of FIG. 3.

Referring to FIG. 3, the first current controller 131 of the first driver IC 130 includes a plurality of dimming switches 131*a* and a plurality of current control FETs 131*b*.

The dimming control switches 131*a* (schematically shown as mechanical switches but understood to be electronic switches) that are connected to current control transistors 131*b* of the channels CH1~CHi, respectively, and each of the dimming switches 131*a* is switched from closed to open (turned on and off) in response to the dimming signal Vdim to thus determine a gate control voltage that will be capacitively stored on a parasitic gate capacitor (not shown) of each current control transistor 131*b* to thus control the series current $I_f$ passed through the corresponding light source string (e.g., 120_1) in the presence of the current string driving voltage Vout being applied to the corresponding LED string by the DC/DC converter 110. In other words, each of the LED strings 120_~120_*i* receives the light source driving voltage Vout provided from the DC/DC converter 110 and each current controller 131 may be controllably dimmed by for example controlling the duty ratio of closure of the dimming switches 131*a*. As an example, each dimming switch 1311*a* may be a metal oxide semiconductor field effect transistor (MOSFET) and each current control transistor 131*b* may also be such an FET.

The current control FETs 131*b* are connected to the channels CH1~CHi, respectively, as shown and each of the current control FETs 131*b* has an inherent (parasitic) drain to source resistance and/or an additional source resistance Rc where these resistances are used to sense corresponding feedback currents, $I_f$ of the corresponding channels CH1~CHi when the corresponding current control FET 131*b* is turned on and to a predefined sensing state (to have a reference gate voltage applied thereto).

Although not shown in figures, in order to control the relationship between the sensing resistances (Rds+Rc) and the feedback voltages that result from a given $I_f$ current magnitude consistent, the first current controller 131 may further include a comparison circuit that receives a reference current, $I_{fREF}$ (not shown) passed through a scaled copy of the sensing resistances (Rds+Rc) and it accords the resulting feedback voltage with a predetermined reference value.

The first voltage output unit 132 of the first driver IC 130 further includes a plurality of switching devices 133_1~133_*i* and a plurality of D-type flip-flops 134_1~134_*i*. The switching devices 133_~133_*i* are respectively connected to the channels CH1~CHi to receive the feedback voltages Vf1~Vfi from the channels CH1~CHi.

Each of the switching devices 133_~133_*i* is connected to a corresponding D-flip-flop of the D-flip-flops 134_1~134_*i* and is turned on in response to a logic high output signal being output from the Q output terminal of the corresponding D-flip-flop. In detail, each of the switching devices 133_1~133_*i* includes an input electrode (drain) connected to the corresponding channel, a control electrode (gate) connected to an output Q terminal of the corresponding D-flip-flop, and an output electrode (source) connected to a common feedback line FL. Accordingly, when each switching device is turned on, the feedback voltage fedback from the corresponding channel is provided to the A/D converter 161 through the common feedback line FL.

Each of the D-flip-flops 134_1~134_*i* includes an input terminal D, a clock terminal CK, and an output terminal Q, and the D-flip-flops 134_1~134_*i* are connected to each other one after another. That is, the output terminal Q of a previous D-flip-flop is connected to the input terminal D of a present D-flip-flop and the input terminal D of a next D-flip-flop is connected to the output terminal Q of the present D-flip-flop, and thus the D-flip-flops 134_1~134_*i* may be connected to each other one after another to form a shift register.

In addition, the clock signal CLK is applied to the clock terminal CK of each of the D-flip-flops 134_1~134_*i*, and the output signal is output from the output terminal of each of the D-flip-flops 134_1~134_*i* to control the corresponding switching device.

Among the D-flip-flops 134_1~134_1, a first D-flip-flop 134_1 receives the start signal ST through the input terminal D thereof. When the first D-flip-flop 134_1 starts its operation within a high period of the start signal ST, the D-flip-flops 134_1~134_*i* sequentially operate to turn on the switching devices 133_1~133_*i* one at a time in synchronism with the clock signal CLK. Thus, the switching devices 133_1~133_*i* may be sequentially turned on. As a result, the feedback voltages Vf1~Vfi fedback from the channels CH1~CHi may be sequentially provided to the A/D converter 161 through the common feedback line FL.

Referring to FIG. 4, the clock signal CLK provided to the clock terminal CK of the D-flip-flops 134_1~134_*i* synchronizes with the dimming signal Vdim provided to the first current controller 131. As described above, since the LED strings 120_1~120_*i* are operated in the high period of the dimming signal Vdim and a reference voltage is supplied to the gates of transistors 131*b* at that time, the clock signal CLK is required to be synchronized with trailing edges of the dimming signal Vdim such that the first voltage output unit 132 outputs the feedback voltages provided from the channels CH1~CHi. Particularly, the clock signal CLK has a frequency same as a frequency of trailing edges of the dimming signal Vdim or a frequency N times (N is an integer larger than 1) larger than the frequency of the dimming signal Vdim.

When the first D-flip-flop 134_1 starts its operation by the start signal ST, a first output signal is output from the output terminal of the first D-flip-flop 134_1 during a first high period of the clock signal CLK. The first output signal is applied to a first switching device 133_1 to turn on the first switching device 133_1. Accordingly, a first feedback voltage Vf1 fedback from a first channel CH1 is provided to the feedback line FL through the turned-on first switching device 133_1.

The A/D converter 161 reads in the first feedback voltage Vf1 provided to the feedback line FL in response to a read-out signal R0. At the time that R0 is high, the reference gate voltage for transistors 131*b* is fed in through their respectively gate-driving switches 131*a*. Thus, in the present exemplary embodiment, the active read-out signal R0 occurs during the high period (ON period) near the trailing edge of each high Vdim signal. In particular, as an example of the present invention, the high period of the read-out signal R0 may be included in the last 1% duty ratio portion, Dut1% of the dimming signal Vdim.

As described above, since the duty ratio of the dimming signal Vdim varies depending upon the desired brightness of the image signal in the dimming method, the turned-on duration of the dimming signal Vdim may be variable. However the last 1% portion, Dut1% may be caused to be always present (unless the duty ratio is zero).

In addition, the feedback voltage of each channel has the lowest voltage level at the end of the high period of the dimming signal Vdim. Thus, when the read-out signal R0 occurs in the 1% duty ratio Dut1 portion of the dimming signal Vdim, the A/D converter 161 may read out the feedback voltages Vf1~Vfi at the timing at which the feedback voltages Vf1~Vfi have the lowest voltage levels just before the respectively light source strings have their current turned off.

Meanwhile, the output signal output from the first D-flip-flop 134_1 is provided to the input terminal D of the second D-flip-flop 134_2. The second D-flip-flop 134_2 outputs the output signal from the first D-flip-flop 134_1 through the output terminal thereof during a second high period of the clock signal CLK. Accordingly, the second switching device 133_2 is turned on in response to the output signal from the second D-flip-flop 134_2, so that the feedback voltage Vf2 fedback from the second channel CH2 is provided to the feedback line FL. Then, the A/D converter 161 may read out the second feedback voltage Vf2 in the second high period of the read-out signal R0.

As described above, the feedback voltages Vf1~Vfi fedback from the channels CH1~CHi of the first driver IC 130 may be sequentially applied to the A/D converter 161.

Referring to again FIG. 3, the second and third driver ICs 140 and 150 have the same circuit configuration as the first driver IC 130, and thus detailed descriptions of the second and third driver ICs 140 and 150 will be omitted here.

In the present exemplary embodiment, an input terminal D of a first D-flip-flop 144_1 among plural D-flip-flops 144_1~144_*i* included in the second voltage output unit 142 of the second driver IC 140 may be connected to an output terminal Q of a last D-flip-flop 134_*i* of the first voltage output unit 134. Accordingly, after all the feedback voltages Vf1~Vfi of the channels CH1~CHi are provided to the A/D converter 161 through the first voltage output unit 134, the second voltage output unit 142 starts its operation to sequentially supply the feedback voltages Vfi+1~Vf2*i* fedback from the corresponding channels CHi+1~CH2*i* to the A/D converter 161.

Similar to the above, an input terminal D of a first D-flip-flop 154_1 among plural D-flip-flops 154_1~154_*i* included in the third voltage output unit 152 of the third driver IC 150 may be connected to an output terminal Q of a last D-flip-flop 144_*i* of the second voltage output unit 144. Accordingly, after all the feedback voltages Vfi+1~Vf2*i* of the channels CHi+1~CH2*i* are provided to the A/D converter 161 through the second voltage output unit 144, the third voltage output unit 152 starts its operation to sequentially supply the feedback voltages Vf2*i*+1~Vf3*i* fedback from the corresponding channels CH2*i*+1~CH3*i* to the A/D converter 161.

Consequently, the A/D converter 161 sequentially receives the feedback voltages Vf1~Vf3*i* fedback from the channels CH1~CH3*i* and converts the feedback voltages Vf1~Vf3*i* into the digital signals D1~D3*i*.

In FIG. 3, the circuit configuration that the first to third voltage output units 132, 142, and 152 are sequentially operated has been shown, but it should not be limited thereto or thereby. That is, the first to third voltage output units 132, 142, and 152 may substantially simultaneously start their operations if they have their own private feedback lines rather than sharing a common feedback line FL. In a case that the first to third voltage output units 132, 141, and 152 substantially simultaneously start their operations, the start signal ST is substantially simultaneously applied to the first D-flip-flops 134_1, 144_1, and 154_1 of the first to third voltage output units 132, 142, and 152. Also, the number of the feedback lines FL increases from one to three to be provided to each of the first to third voltage output units 132, 142, and 152.

In addition, in FIGS. 2 and 3, a circuit configuration that the first to third voltage output units 132, 142, and 152 are installed inside the first to third driver ICs 130, 140, and 150, respectively, has been shown, but it should not be limited thereto or thereby. That is, the first to third voltage output units 132, 142, and 152 may be disposed outside the first to third driver ICs 130, 140, and 150. In this case, each voltage output unit is connected to the channel of the corresponding driver ICs to receive the feedback voltages.

Further, in FIG. 1, a circuit configuration that the minimum voltage detecting circuit 160 and the voltage control circuit 170 are separately integrated and installed with respect to the first to third driver ICs 130, 140, and 150 has been shown, but it should not be limited thereto or thereby. In detail, the minimum voltage detecting circuit 160 and the voltage control circuit 170 may be installed inside one driver IC selected from the driver ICs in the backlight unit 100.

As described above, in the backlight unit 100 of which the LED strings 120_1~120_3*i* are operated by the driver ICs 130, 140, and 150, the driver ICs 130, 140, and 150 include the voltage output units 132, 142, and 152, respectively, and the minimum voltage detecting circuit 160 is installed outside the driver ICs 130, 140, and 150. Thus, the minimum voltage of the feedback voltages Vf1~Vf3*i* of the LED strings 120_1~120_3*i* may be effectively detected without relation to the number of the driver ICs.

Figure 5:
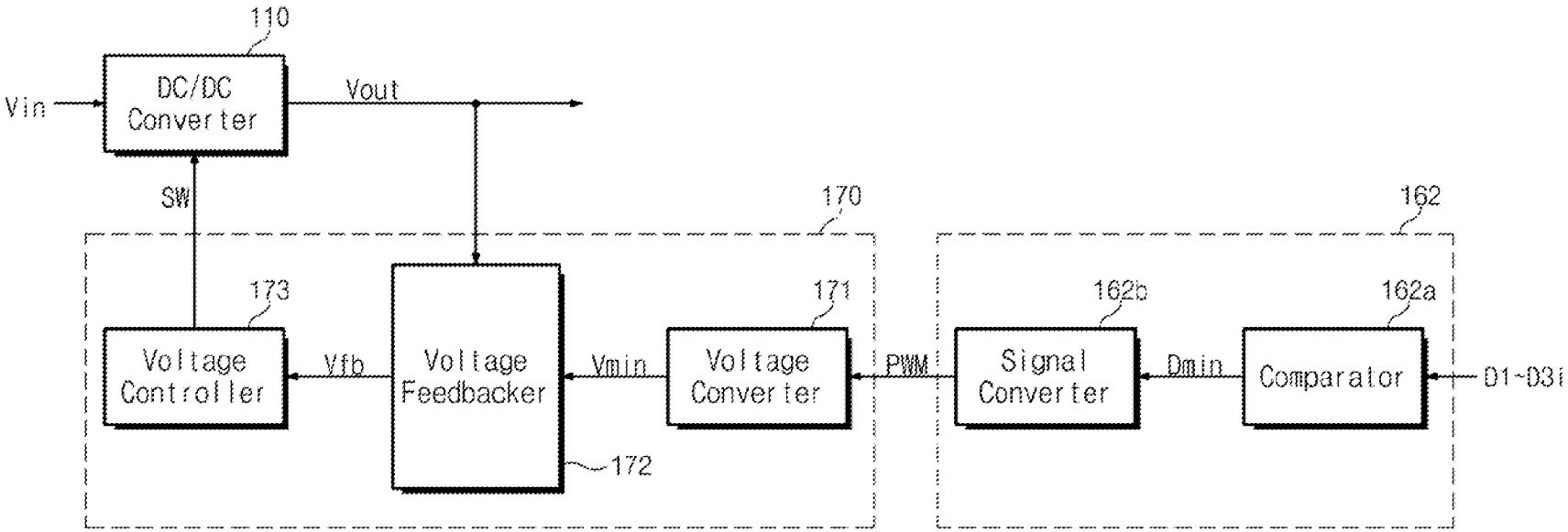
FIG. 5 is a block diagram showing a central processing unit and a voltage control circuit of FIG. 1.
Figure 6:
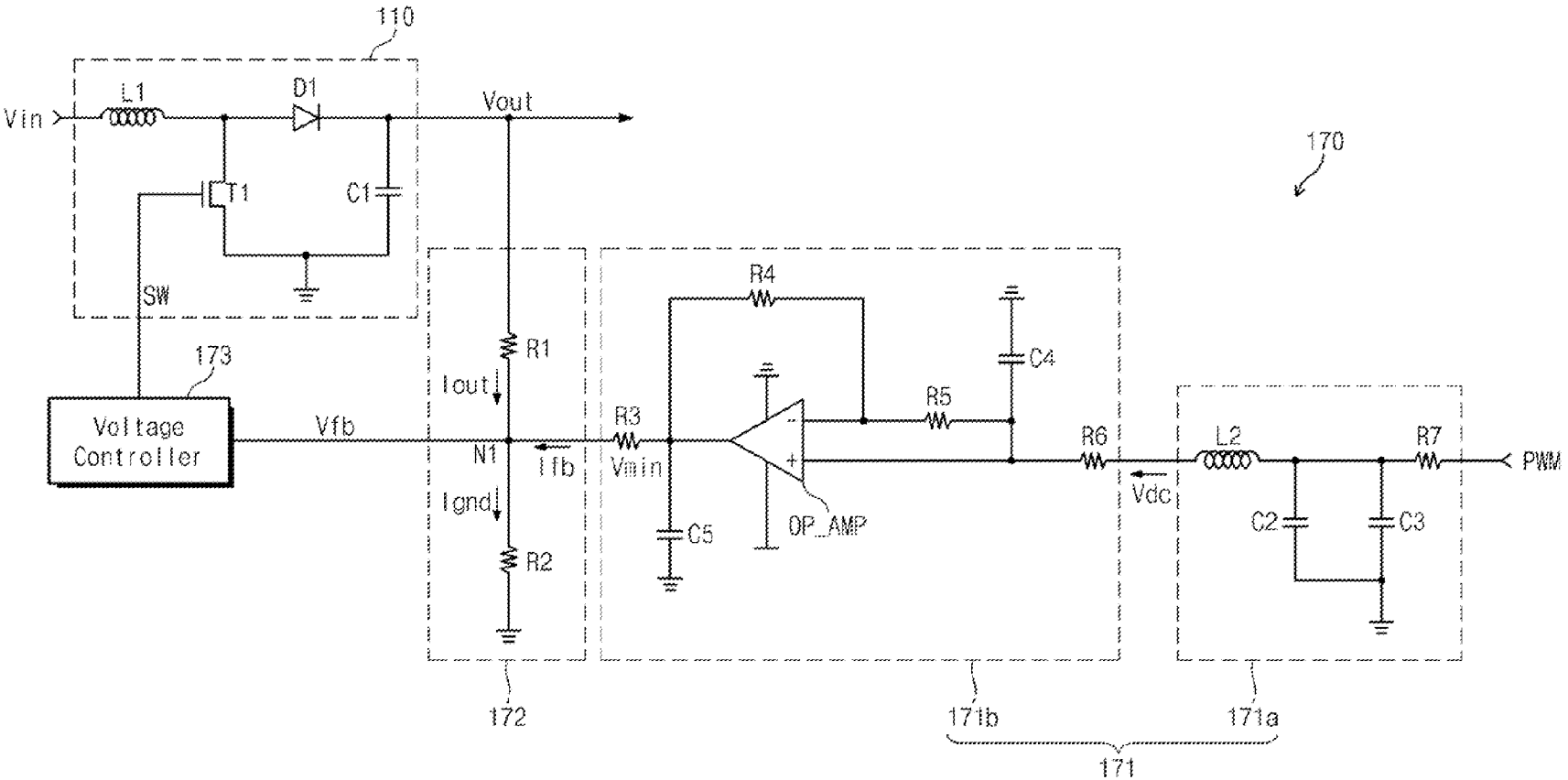
FIG. 6 is a circuit diagram showing a voltage converter and a voltage feedbacker of FIG. 5.

FIG. 5 is a block diagram showing a central processing unit (CPU 162) and a voltage control circuit (170) such as that of FIG. 1, and FIG. 6 is a circuit diagram showing a voltage converter 171 and a voltage feedbacker 172 such as that of FIG. 5.

Referring to FIG. 5, the central processing unit 162 receives the digital signals D1~D3*i* from the A/D converter 161 and identifies a minimum digital signal Dmin corresponding to the minimum voltage level from the received digital signals D1~D3*i*. To this end, the central processing unit 162 may include a digital comparator 162*a* and a D/A signal converter 162*b*.

The comparator 162*a* compares the digital signals D1~D3*i* with each other and reads out the minimum digital signal Dmin corresponding to the minimum voltage level among the digital signals D1~D3*i*. The read-out minimum digital signal Dmin is provided to the signal converter 162*b*, and the signal converter 162*b* converts the minimum digital signal Dmin into a pulse width modulation signal PWM. The pulse width modulation signal PWM has a duty ratio that is variable within a predetermined range depending on the size of the minimum digital signal Dmin.

The voltage control circuit 170 includes a voltage converter 171, a voltage feedbacker 172, and a voltage controller 173.

The voltage converter 171 converts the pulse width modulation signal PWM into a minimum voltage signal Vmin and outputs the corresponding minimum voltage signal Vmin. The voltage feedbacker 172 receives the light source driving voltage Vout from the DC/DC converter 110 and the minimum voltage signal Vmin from the voltage converter 171 and combines the currents, Iout and Ifb associated with the light source driving voltage Vout and the minimum voltage signal Vmin respectively to generate a final feedback voltage Vfb. The voltage controller 173 outputs the switching signal SW to control the DC/DC converter 110 based on the final feedback voltage Vfb. Thus, the voltage level of the light source driving voltage Vout output from the DC/DC converter 110 may be adjusted by a minimum feedback voltage level of the feedback voltages of the LED strings 120_1~120_3*i*.

As an example, the voltage control circuit 170 may have the mixed analog digital circuit configuration as shown in FIG. 6.

Referring to FIG. 6, the voltage converter 171 includes an RLC filter section 171*a* and a voltage follower amplifier 171*b*. The RLC filter 171*a* includes a resistor R7, a coil L2, and two capacitors C2 and C3 to integrate over time and thus convert the pulse width modulation signal PWM provided through the seventh resistor R7 from the central processing unit 162 into a corresponding direct current voltage Vdc. In this case, a voltage level of the direct current voltage Vdc depends on the duty ratio of the pulse width modulation signal PWM.

The voltage follower 171*b* includes an operational amplifier OP_AMP including a first terminal (+) through which the direct current voltage Vdc is provided and a second terminal (−) connected to an output terminal thereof. The voltage follower 171*b* may further include capacitors C4 and C5 and resistors R3, R4, R5, and R6 connected as a ladder network. The voltage follower 171*b* serves as a high input impedance buffer that outputs the direct current voltage Vdc provided through the first terminal (+) to the output terminal thereof. Accordingly, the voltage converter 171 may output a predefined fraction of the direct current voltage Vdc as the minimum voltage signal Vmin to section 172.

The voltage feedbacker 172 includes first and second resistors R1 and R2. The first and second resistors R1 and R2 are connected to each other in series between the output terminal of the DC/DC converter 110 and a ground voltage terminal. In addition, the minimum voltage signal Vmin output from the voltage follower 171*b* is applied via R3 to a coupling node N1 to which the first and second resistors R1 and R2 are connected.

Thus, an electric potential at the coupling node N1 is provided to the voltage controller 173 as the final feedback voltage Vfb.

According to Kirchhoff's Current Law (KCL), the algebraic sum of currents at the coupling node N1 becomes zero. Thus, the following Equation 1 comes into existence.

$$Iout+Ifb-Ignd=0 \qquad \text{Equation 1}$$

When the current is expressed by the resistance R and the voltage V, the following Equation 2 comes into existence.

$$\frac{(Vout-Vfb)}{R1}+\frac{(Vmin-Vfb)}{R2}-\frac{Vfb}{R2}=0 \qquad \text{Equation 2}$$

Then, the maximum light source driving voltage $Vout_{max}$ and the minimum light source driving voltage $Vout_{min}$ are substituted instead of the light source driving voltage Vout to generate two numeric formulas. When Equation 2 is rearranged by using the two numeric formulas, the following Equation 3 comes into existence.

$$Vout_{max}-Vout_{min}=\frac{(Vfb_{max}-Vfb_{min})R1}{R3} \qquad \text{Equation 3}$$

According to Equation 3, the light source driving voltage Vout may be controlled by corresponding controlled variation of the final feedback voltage Vfb.

As shown in FIG. 6, the voltage controller 173 receives the final feedback voltage Vfb and outputs the switching signal SW to control the DC/DC converter 110.

The DC/DC converter 110 includes an inductor L1 for boosting the input voltage Vin, a diode D1 uniformly maintaining the boosted voltage, a capacitor C1 stabilizing the boosted voltage, and a switching device Ti receiving the switching signal SW.

The switching device Ti is turned on or off in response to the switching signal SW, and the inductor L1 produces sufficient current when its magnetic field collapses so as to boost the input voltage Vin according to the On and Off of the switching device Ti and produce the desired and larger Vout level having the controlled minimum and maximum levels, $V_{out_min}$ and $V_{out_max}$. Accordingly, the voltage level of the light source driving voltage Vout output from the DC/DC converter 110 may be varied depending upon the duty ratio of the switching signal SW.

In other words, when the duty ratio of the switching signal SW is reduced, the voltage level of the light source driving voltage Vout output from the DC/DC converter 110 decreases. On the contrary, when the duty ratio of the switching signal SW increases, the voltage level of the light source driving voltage Vout output from the DC/DC converter 110 increases.

Thus, the voltage level of the light source driving voltage Vout output from the DC/DC converter 110 may be controlled based on the feedback voltages Vf1~Vf3*i* fedback from the LED strings 120_1~120_3*i*. Particularly, in the backlight unit 100 including the driver ICs 130, 140, and 150, the voltage level of the light source driving voltage Vout may be controlled corresponding to the minimum voltage of the feedback voltages Vf1~Vf3*i* fedback from the LED strings 120_1~120_3*i*.

If the size of the applied voltage Vout to the LED strings 120_1~120_3*i* increases uncontrollably, then power consumption used in the strings and through the current control FETs 131*b*, 141*b*, and 151*b* in each driver IC 130, 140, and 150 increases uncontrollably and may damage the current control FETs 131*b*, 141*b*, and 151*b*. However, when the light source driving voltage Vout is controlled by the minimum feedback voltage, the power consumption caused by the current control FETs 131*b*, 141*b*, and 151*b* (and the resultant heat generated) in the current controllers 131, 141, and 151 may be reduced.

Figure 7A:
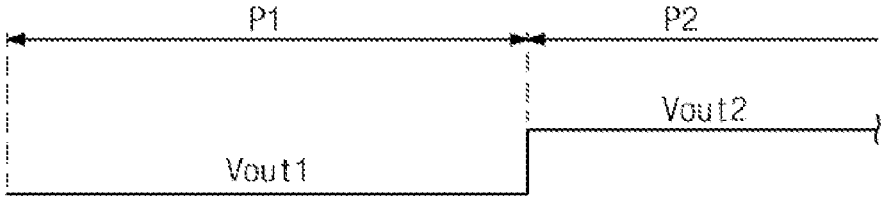
FIG. 7A is a waveform diagram showing variations of a light source driving voltage of FIG. 6.
Figure 7B:
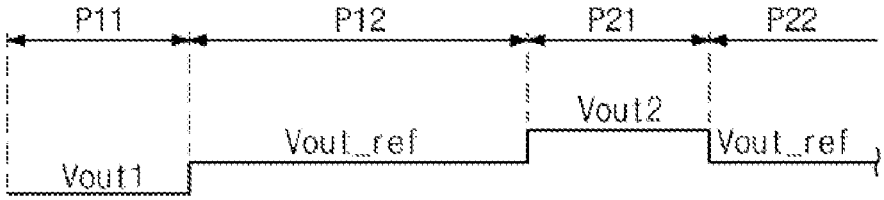
FIG. 7B is a waveform diagram showing variations of a light source driving voltage according to another exemplary embodiment.
Figure 7C:
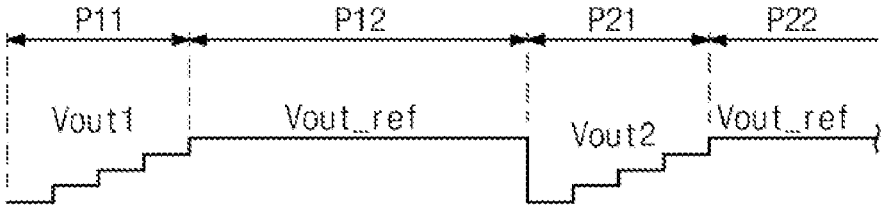
FIG. 7C is a waveform diagram showing variations of a light source driving voltage according to another exemplary embodiment.

FIG. 7A is a waveform diagram showing variations of a light source driving voltage of FIG. 6, FIG. 7B is a waveform diagram showing variations of a light source driving voltage according to another exemplary embodiment of the present invention, and FIG. 7C is a waveform diagram showing variations of a light source driving voltage according to another exemplary embodiment of the present invention.

Referring to FIG. 7A, when assuming that a time interval used to detect the feedback voltages Vf1~Vf3*i* (shown in FIG. 1) from the LED strings 120_1~120_3*i* (shown in FIG. 1) in the backlight unit 100 (shown in FIG. 1) and to read out the minimum voltage is set as one feedback period, a present light source driving voltage varies depending on a previous minimum voltage that is read out in a previous feedback period. That is, the DC/DC converter 110 (shown in FIG. 1) outputs a first light source driving voltage Vout1 during a first feedback period P1 according to the previous minimum voltage, and the DC/DC converter 110 outputs a second light source driving voltage Vout2 during a second light source driving voltage Vout2 according to the minimum voltage that is read out in the first feedback period P1.

As described above, the voltage level of the first and second light source driving voltages Vout1 and Vout2 may be controlled by the duty ratio of the switching signal SW provided to the switching device Ti of the DC/DC converter 110.

When the first light source driving voltage Vout1 is rapidly changed to the second light source driving voltage Vout2 at the boundary between the first and second feedback periods P1 and P2, users may perceive suddenly flashed brightness variations due to backlight variations provided by the backlight unit 100.

As shown in FIG. 7B, a first feedback period P1 according to another exemplary embodiment includes a first sub-feedback period P11 during which the first light source driving voltage Vout1 is output and a reference feedback period P12 during which a reference light source driving voltage Vout_ref is output. The reference light source driving voltage Vout_ref may correspond to an average value of the maximum light source driving voltage $Vout_{max}$ and the minimum light source driving voltage $Vout_{min}$. In this case, the users may be prevented from perceiving the annoying blinking brightness variations of the backlight unit 110, which may occur at the boundary between the first and second feedback periods P1 and P2.

In addition, as shown in FIG. 7C, the first light source driving voltage Vout1 may be gradually varied during the first sub-feedback period P11, and the second light source driving voltage Vout2 may be gradually varied during a second sub-feedback period P21. As a result, the users may be more effectively prevented from perceiving the sudden brightness variations of the backlight unit 110, which occur at the boundary between the first and second feedback periods P1 and P2.

Figure 8:
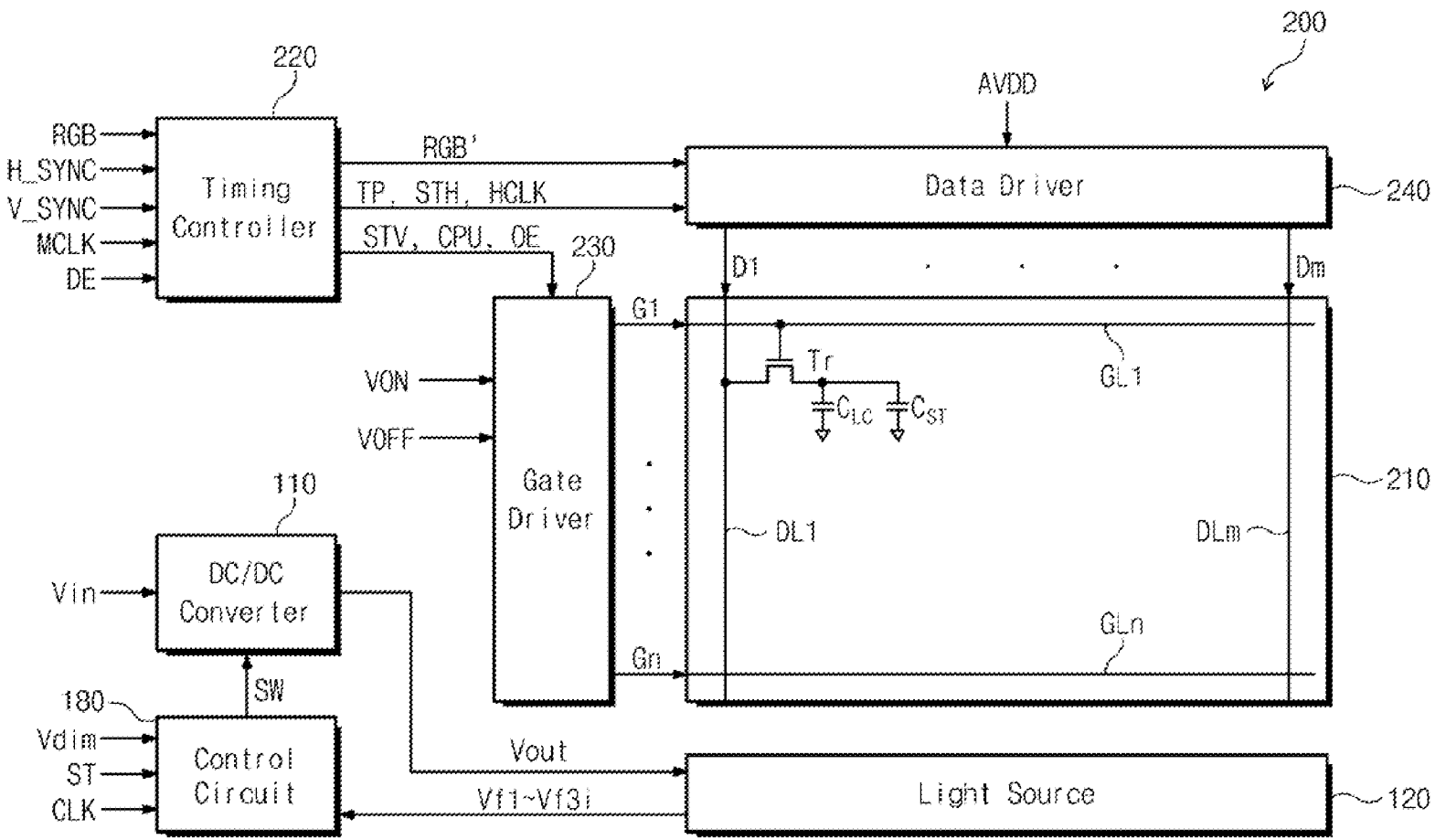
FIG. 8 is a block diagram showing an exemplary embodiment of a display apparatus according to the present disclosure.

FIG. 8 is a block diagram showing an exemplary embodiment of a display apparatus according to the present invention.

Referring to FIG. 8, a display apparatus 200 includes a liquid crystal display panel 210, a timing controller 220, a gate driver 230, a data driver 240, and a backlight unit 100.

The liquid crystal display panel 210 (TFT substrate) includes a plurality of gate lines GL1~GLn, a plurality of data lines DL1~DLm crossing the gate lines GL1~GLn, and a plurality of pixels. Each pixel includes a thin film transistor Tr having a gate electrode connected to a corresponding gate line of the gate lines GL1~GLn and a source electrode connected to a corresponding data line of the data lines DL1~DLm, a liquid crystal capacitor $C_{LC}$ (defined by its pixel-electrode and facing portion of the common electrode) connected to a drain electrode of the thin film transistor Tr, and a storage capacitor $C_{ST}$. For the convenience of explanation, only one pixel has been shown.

The timing controller 220 receives an image data signal RGB, a horizontal synchronizing signal H_SYNC, a vertical synchronizing signal V_SYNC, a clock signal MCLK, and a data enable signal DE from an external device. The timing controller 220 converts a data format of the image data signal RGB into a data format appropriate to an interface between the timing controller 220 and the data driver 240 and outputs the converted image data signal RGB' to the data driver 240.

In addition, the timing controller 220 outputs data control signals, such as an output start signal TP, a horizontal start signal STH, a clock signal HCLK, to the data driver 240, and outputs gate control signals, such as a vertical start signal STV, a gate clock signal CPV, an output enable signal OE, to the gate driver 230.

The gate driver 230 receives a gate-on voltage Von and a gate-off voltage Voff and sequentially outputs gate signals G1~Gn having the gate-on voltage Von in response to the gate control signals STV, CPV, and OE provided from the timing controller 220. The gate signals G1~Gn are sequentially applied to the gate lines GL1~GLn of the liquid crystal display panel 210 to sequentially scan the gate lines GL1~GLn.

Although not shown in FIG. 8, the display apparatus 200 may further include a regulator that converts an input logic voltage into the gate-on voltage Von and the gate-off voltage Voff.

The data driver 240 converts the image data signal RGB' into data signals D1~Dn in response to the data control signals TP, STH, and HCLK provided from the timing controller 220 and applies the data signals D1~Dn to the data lines DL1~DLm.

When the gate signals G1~Gn are sequentially applied to the gate lines GL1~GLn one at a time, the data signals D1~Dm are applied to the data lines DL1~DLm as each row is strobed by a respective gate line. For instance, if the gate signal is applied to the corresponding gate line selected from the gate lines GL1~GLn, the thin film transistor Tr connected to the selected gate line is turned on the gate signal applied to the selected gate line. Therefore, the data signal applied to the data line connected to the turned-on thin film transistor Tr is charged to the liquid crystal capacitor $C_{LC}$ and the storage capacitor $C_{ST}$ through the turned-on thin film transistor Tr.

Voltage across the liquid crystal capacitor $C_{LC}$ controls transmittance of liquid crystals that form the dielectric therein. The storage capacitor $C_{ST}$ helps store charge from the data signal when the thin film transistor Tr is turned on and continues to apply the stored data signal to the liquid crystal capacitor $C_{LC}$ when the thin film transistor Tr is turned off, so that the liquid crystal capacitor $C_{LC}$ may maintain the voltage charged thereto. As a result, the liquid crystal display panel 210 may display images.

The backlight unit 100 includes a light source unit 120, a DC/DC converter 110, and a control circuit 180. The light source unit 120 is disposed at a rear of the liquid crystal display panel 210 and supplies light to the liquid crystal display panel 210 in response to a light source driving voltage Vout provided from the DC/DC converter 110.

The DC/DC converter 110 boosts an input voltage Vin to the light source driving voltage Vout and supplies the light source driving voltage Vout to the light source unit 170. The control circuit 180 may include the driver ICs 130, 140, and 150, the minimum voltage detecting circuit 160, and the voltage control circuit 170. Thus, detailed description of the control circuit 180 will be omitted.

According to the above-described display apparatus 200, the backlight unit 100 sequentially receives the feedback voltages Vf1~Vf3*i* fedback from the LED strings 120_1~120_3*i*. The backlight unit 100 detects the minimum voltage among the feedback voltages Vf1~Vf3*i* and varies the voltage level of the light source driving voltage Vout corresponding to the minimum voltage, so as to thereby prevent runway increase of Vout and thereby reduce the power consumption of the display apparatus 200 substantially beyond what is minimally necessary to obtain a desired minimum luminance from each turned on light source strings.

Although the exemplary embodiments in accordance with the disclosure have been described, it is understood that the present teachings should not be limited to these exemplary embodiments but various changes and modifications can be made by one ordinary skilled in the art after having read this disclosure, as may be within the spirit and scope of the present teachings.

What is claimed is:

1. A backlight unit comprising:

a boosting circuit that boosts an input voltage to a light source driving voltage;

a light source unit that includes a plurality of light source strings grouped into a plurality of light generating groups, the light source strings being commonly connected to an output terminal of the boosting circuit to generate a light in response to the light source driving voltage;

a plurality of driving circuits each connected to the light generating groups, respectively, and configured to sequentially output feedback voltages fedback from the light source strings of a corresponding light generating group of the light source generating groups;

a minimum voltage detecting circuit that receives the feedback voltages from the driving circuits, compares the feedback voltages with each other to detect a minimum voltage, and outputs a control signal according to the detected minimum voltage; and a voltage control circuit that controls the boosting circuit in response to the control signal to control a voltage level of the light source driving voltage supplied to the light source unit, wherein each of the driving circuits comprises:

a plurality of switching devices each of which is connected to the light source strings of the corresponding light generating group to receive the feedback voltages, and a plurality of D-flip-flops connected to the switching devices, respectively, to sequentially supply an output signal to the switching devices in response to the clock signal.

2. The backlight unit of claim 1, wherein each of the switching devices comprises: a control electrode that receives the output signal from a corresponding D-flip-flop of the D-flip-flops; an input electrode that receives a corresponding feedback voltage from the corresponding light source strings; and an output electrode connected to the minimum voltage detecting circuit to output the corresponding feedback voltage.

3. The backlight unit of claim 2, wherein each of the D-flip-flop comprises a clock terminal receiving the clock signal, an input terminal connected to an output terminal of a previous D-flip-flop, and an output terminal connected to the control electrode of a corresponding switching device of the switching devices, an input terminal of a first D-flip-flop of a first driving circuit of the driving circuits receives a start signal, and an output terminal of a last D-flip-flop of the D-flip-flops is connected to an input terminal of a first D-flip-flop of an adjacent driving circuit thereto.

4. The backlight unit of claim 1, wherein each of the driving circuits further comprises a current controller controls a turn-on period of the corresponding light source strings in response to a dimming signal and controls currents fedback from the corresponding light source strings to have a same size.

5. The backlight unit of claim 4, wherein the clock signal has a frequency same as or N (N is an integer larger than 1) times larger than a frequency of the dimming signal.

6. The backlight unit of claim 4, wherein the minimum voltage detecting circuit comprises: an analog-to-digital converter that sequentially receives the feedback voltages in response to a read-out signal and converts the feedback voltages into digital signals; and a central processing unit that outputs the control signal corresponding to the minimum voltage by using the digital signals.

7. The backlight unit of claim 6, wherein the read-out signal is generated within 1% duty ratio of the dimming signal.

8. The backlight unit of claim 6, wherein the central processing unit comprises: a comparator that compares the digital signals with each other to output a minimum digital signal corresponding to the minimum voltage; and a signal converter that receives the minimum digital signal, generates a pulse width modulation signal having a duty ratio corresponding to the minimum digital signal, and outputs the pulse width modulation signal as the control signal.

9. The backlight unit of claim 1, wherein, when assuming that a time interval used to provide all the feedback voltages from the light source strings to the minimum voltage detecting circuit is set as a feedback period, the light source driving voltage has a voltage level during a first period of the feedback period, which is varied depending on a minimum voltage that is read out in a previous feedback period, and the light source diving voltage has a predetermined reference voltage level during a remaining second period of the feedback period.

10. The backlight unit of claim 9, wherein the voltage level of the light source driving voltage gradually varies during the first period.

11. The backlight unit of claim 1, wherein the voltage control circuit comprises: a voltage converter that converts the control signal into a minimum feedback voltage; a voltage feedbacker connected to the output terminal of the boosting circuit to receive the light source driving voltage and receive the minimum feedback voltage from the voltage converter; and a voltage controller that generates a switching signal based on a final feedback voltage fedback from the voltage feedbacker and controls the boosting circuit by using the switching signal to vary the voltage level of the light source driving voltage.

12. The backlight unit of claim 11, wherein the voltage feedbacker comprises first and second resistors connected to each other in series between the output terminal of the boosting circuit and a ground terminal, and the voltage converter provides the minimum feedback voltage to a coupling node to which the first and second resistors are connected.

13. The backlight unit of claim 1, wherein each of the light source strings comprises a plurality of light emitting diodes connected to each other in series, and the light source strings are connected to each other in parallel.

14. The backlight unit of claim 1, wherein each of the driving circuits comprises an integrated circuit, and the minimum voltage detecting circuit is installed inside one of the driving circuits.

15. A display apparatus comprising:

a backlight unit generating a light; and a display unit receiving the light to display an image, wherein the backlight unit comprises:

a boosting circuit that boosts an input voltage to a light source driving voltage;

a light source unit that includes a plurality of light source strings grouped into a plurality of light generating groups, the light source strings being commonly connected to an output terminal of the boosting circuit to generate a light in response to the light source driving voltage;

a plurality of driving circuits each connected to the light generating groups, respectively, and configured to sequentially output feedback voltages fedback from the light source strings of a corresponding light generating group of the light source generating groups;

a minimum voltage detecting circuit that receives the feedback voltages from the driving circuits, compares the feedback voltages with each other to detect a minimum voltage, and outputs a control signal according to the detected minimum voltage; and a voltage control circuit that controls the boosting circuit in response to the control signal to control a voltage level of the light source driving voltage supplied to the light source unit, wherein each of the driving circuit comprises:

a plurality of switching devices each of which is connected to the light source strings of the corresponding light generating group to receive the feedback voltages, and a plurality of D-flip-flops connected to the switching devices, respectively, to sequentially supply an output signal to the switching devices in response to the clock signal.

16. The display apparatus of claim 15, wherein each of the driving circuits further comprises a current controller controls a turn-on period of the corresponding light source strings in response to a dimming signal and controls currents fedback from the corresponding light source strings to have a same size.

17. The display apparatus of claim 15, wherein the minimum voltage detecting circuit comprises: an analog-to-digital converter that sequentially receives the feedback voltages in response to a read-out signal and converts the feedback voltages into digital signals; and a central processing unit that outputs the control signal corresponding to the minimum voltage by using the digital signals.

18. The display apparatus of claim 15, wherein the voltage control circuit comprises: a voltage converter that converts the control signal into a minimum feedback voltage; a voltage feedbacker connected to the output terminal of the boosting circuit to receive the light source driving voltage and receive the minimum feedback voltage from the voltage converter; and a voltage controller that generates a switching signal based on a final feedback voltage fedback from the voltage feedbacker and controls the boosting circuit by using the switching signal to vary the voltage level of the light source driving voltage.

* * * * *